US008261453B2

(12) United States Patent
Huang

(10) Patent No.: US 8,261,453 B2
(45) Date of Patent: Sep. 11, 2012

(54) PLASTIC PIPE CUTTING TOOL

(75) Inventor: Zhonghua Huang, Zhejiang (CN)

(73) Assignee: Ningbo JF Tools Industrial Co., Ltd., Yuyao, Zhejiang Province (CN)

( * ) Notice: Subject to any disclaimer, the term of this patent is extended or adjusted under 35 U.S.C. 154(b) by 492 days.

(21) Appl. No.: 12/508,423

(22) Filed: Jul. 23, 2009

(65) Prior Publication Data

US 2010/0018059 A1 Jan. 28, 2010

(30) Foreign Application Priority Data

Jul. 25, 2008 (CN) ..... 2008 2 0122180 U
Oct. 29, 2008 (CN) ..... 2008 2 0167079 U
Oct. 29, 2008 (CN) ..... 2008 2 0167080 U

(51) Int. Cl.
*B23D 21/10* (2006.01)
*B26D 3/16* (2006.01)

(52) U.S. Cl. ..... 30/92; 30/228; 30/277.4

(58) Field of Classification Search ..... 30/92, 228, 30/244, 245, 247, 277.4, 263, 264
See application file for complete search history.

(56) References Cited

U.S. PATENT DOCUMENTS 2,731,721 A * 1/1956 Traurig ..... 144/253.4
3,350,780 A * 11/1967 Artru et al. ..... 30/228
5,067,240 A * 11/1991 You ..... 30/249
5,897,454 A * 4/1999 Cannaliato ..... 475/265
5,987,754 A * 11/1999 Hirabayashi et al. ..... 30/228
6,178,643 B1 * 1/2001 Erbrick et al. ..... 30/228
7,293,362 B2 * 11/2007 Konen ..... 30/388
2011/0005083 A1 * 1/2011 Scott et al. ..... 30/92
2011/0219626 A1 * 9/2011 Broeker et al. ..... 30/92
2011/0258859 A1 * 10/2011 Schofield et al. ..... 30/228

FOREIGN PATENT DOCUMENTS

EP 2 147 735 A2 * 1/2010
WO WO 2009/006587 * 1/2009

* cited by examiner

*Primary Examiner* — Hwei C Payer
(74) *Attorney, Agent, or Firm* — Global IP Services; Tianhua Gu

(57) ABSTRACT

The present invention relates to a plastic pipe cutting tool comprising a housing body with handle, a blade holder mounted on the housing body and a rotatable blade associated with the blade holder to form a cutting opening, is characterized in that said housing body is provided with a motor which is drivable connected with said blade, and is further provided with a power supply which is electrically connected with the motor by switch to form a loop circuit. The plastic pipe cutting tool according to the present invention is driven by electric and can decrease labor intensity, and is light and easy-carried.

8 Claims, 16 Drawing Sheets

PLASTIC PIPE CUTTING TOOL

CROSS REFERENCE TO THE RELATED PATENT APPLICATION

The present application claims the priority of the Chinese patent applications No. 200820122180.0 filed on Jul. 25, 2008, No. 200820167079.7 filed on Oct. 29, 2008, No. 200820167080.X filed on Oct. 29, 2008, which applications are incorporated herein by reference.

TECHNICAL FIELD

The present invention for utility model relates to a cutting tool, particularly used for cutting PVC plastic pipe, aluminum-plastic compound pipe or the like.

TECHNICAL BACKGROUND

As progress of science and technology, various kinds of plastic pipe and aluminum-plastic compound pipe are applied in the occasions where people live and work. During the application of PVC plastic pipe, a cutting knife is usually used for cutting plastic pipes so as to make it into the length required, thus many scientists devote to develop novel cutting knife or cutter suitable for cutting plastic pipe.

The Chinese patent No. 200720109332.9 disclosed a "rotary cutting knife convenient to cut large diameter pipe", but there are deficiencies that the cutting is laborious due to manual operation, and the cutting knife itself has a complicate structure, occupies large space, and is heavy and high-cost, therefore a further improvement is needed.

The Chinese patent No. 2007201110120.2 disclosed a "forcipate PVC pipe cutting knife with automatic knife-quitting structure", but there are also such deficiencies, that is, the cutting is laborious due to manual operation, and the cutting knife itself has a complicate structure, and is high-cost. In particular the rollback mechanism was not so compact and effective, and therefore a further improvement is also needed.

SUMMARY OF THE INVENTION

One of the primary objectives of the present invention is to provide an electric plastic pipe cutting tool that can decrease labor intensity, and is light and easy-carried.

Another objective of the present invention is to provide a plastic pipe cutting tool having a simple and practical structure, occupies small space and being capable of fast knife-quitting.

To achieve the primary objective of present invention overcoming the above-mentioned technical problems, one primary aspect of the present invention thus provides a plastic pipe cutting tool comprising:

a housing body with handle, a blade holder mounted on the housing body and a rotatable blade associated with the blade holder to form a cutting opening, is characterized in that said housing body is provided with a motor which is drivable connected with said blade, and is further provided with a power supply which is electrically connected with the motor by switch to form a loop circuit.

Preferably said motor is connected with said blade by a variable speed gearing mechanism.

As further improvements, said variable speed gearing mechanism comprises a variable speed frame mounted in the housing body, the variable speed frame is provided with plurality of parallel gear shafts that sleeved with ladderlike duplex gear which are engaged with each other so to form a multi-grade variable speed mechanism, the last duplex gear is engaged with partial gear on the tail portion of blade on which spaces are provided respectively on its front portion and rear portions preventing from transmission. By application of parallel-shafted cylindrical gear transmission in fixed-shaft gear train, the cutting tool of present invention has advantages of small volume, large variable ratio, steady performance, high intensity and long working life.

Alternatively, said variable speed gearing mechanism comprise a variable speed frame mounted in the housing body, the variable speed frame is assembled with rotary worm that is connected by a coupling directly or indirectly with the output shaft of motor, the worm is engaged with partial gear on the tail portion of blade on which spaces are provided respectively on its front portion and rear portions for preventing from transmission.

Of course there are other common used combinations having similar functions. As the spaces are arranged on the front and rear portions of partial gear on the tail portion of blade, when the blade rotates to desired position, the motor will not drive the blade by the variable speed gearing mechanism. That makes the structure more reasonable and practical, improves security and prolongs the working life of the blade.

As further improvements, the blade holder is divided into left portion and right portion, and a restriction gasket is lined there between to form an appropriate gap, the blade is disposed by a shaft in the gap, the left portion and the right portion of blade are penetrated by a shaft pin, and are combined and fastened with a screw nut. By this application, it can be convenient to form a cutting opening between the blade and the blade holder, and also can prevent the blade from cutting the blade holder and from swinging, and it can improve the safety and restriction effect due to the spaces provided respectively on the front portion and rear portions on the tail portion of blade for preventing from transmission As further improvements, said motor is fastened to the blade holder, and is disposed with a gearbox on the output terminal, and the output shaft of gear box cross through a via hole on the blade holder to engage with gear of variable speed mechanism. By this application fixity of assembly is further improved as well as cutting torsion of the blade.

As further improvements, said power supply can use rechargeable battery that is disposed in a battery chamber and is connected with a charging socket on the end of the handle, or can use solar cell that is pasted on the surface of the housing body.

To achieve another objective of present invention overcoming the prior technical problems, the present invention provides another technical solution, that is, a cutting tool comprising the aforementioned technical features and is further characterized in that a clutch mechanism for repositioning the blade is disposed between the last duplex gear in said variable speed gearing mechanism and the partial gear on the tail portion of blade. Accordingly the blade is disposed with a repositioning elastic element providing repositioning trends. By this application, the blade can be repositioned fast, require no reverse rotation of the motor for repositioning the blade, improve working efficiency and prolong the working time of cutting tool with the same energy.

As further improvements, said clutch mechanism is disposed with a clutch spring or a clutch elastic plate between the last duplex gear and the variable speed frame or the housing body to make the duplex gear slide left and right, thereby the duplex gear becomes a clutch gear. Accordingly, a button hole is provided on the surface of the housing body, in which a repositioning button is provided. A button spring is disposed between the repositioning button and the variable speed frame or the housing body. Besides, a side portion of the repositioning button is directly or indirectly contacted with a sidewall of the duplex gear, thereby in the state that the repositioning button is pressed, said duplex gear disengages from the partial gear of tale of blade. By this application, the clutch mechanism is simple and practical, tiny and easy to be operated and manufactured, and the blade can be reposition fast.

Said clutch spring or clutch elastic plate is preferably sleeved on the parallel gear shaft of clutch gear to being convenient for assembly and fixation of the clutch spring or clutch elastic plate.

Said repositioning elastic element can use torsion spring which is sleeved on the shaft of blade or screw nut. One end of the torsion spring is connected with the blade. Alternatively said repositioning elastic element can use tension spring playing the same role.

According to another aspect of the present invention, a partial gear is molded at the rear portion of blade, and a space is disposed between the upper portion of the partial gear and the upper edge of the blade, a transmission gear is mounted on the output shaft of the motor used as power section, and is engaged with the partial gear of the blade.

As further improvements said power section comprises a gearbox fixed on the motor, a power shaft of the motor is used as an input terminal of gearbox, and the output terminal of gearbox is used a output shaft.

As another aspect of the present invention, the middle-rear portion of blade is moveably hinged with one end of a transmission rod, the other end of which is moveably hinged with side portion of an eccentric wheel that is fastened to the output shaft using the motor as power section.

As further improvements, the middle and rear portion of blade is moveably hinged with one end of a transmission rod, the other end of which is moveably hinged with side portion of a crankshaft that is fastened on the output shaft using the motor as power section.

According to another aspect of the present invention, the middle-rear portion of blade is moveably hinged with one end of a transmission rod, the output shaft using the motor as power section has a fixed screw-nut pair comprising a screw, the other end of the transmission rod penetrate a braking element, and is coupled and contacted with one end of the screw.

As further improvements, said power section comprise a gearbox fixed on the motor, a power shaft of the motor is used as input terminal of gearbox, and the output terminal of gearbox is used a output shaft.

Advantages of the present invention are described as followings comparing with the prior arts. By application of the motor driving the blade for rotary cutting, instead of manual operation, and the cutting tool according to the present invention is small and light and convenient for carrying by application of handheld handle. By application of parallel-shafted cylindrical gear transmission in fixed-shaft gear train, the cutting tool according to the present invention has small volume, large variable ratio, steady performance, high intensity and long working life. Besides, since the spaces are arranged on the front and rear portions of partial gear on the tail portion of blade, as the blade rotates to desired position, the motor cannot drive the blade by the variable speed gearing mechanism, it thus makes the structure more reasonable and practical, improves security and prolongs the working life of the blade. By application of unique clutch mechanism which is combined with the duplex gear and is small, compact, simple and practical thereby the blade can be reposition fast without reversion rotation of the motor, it therefore can reduce energy consumption, improve working efficiency and prolong the working time of cutting tool with the same energy.

DESCRIPTION OF REFERENCE NUMERAL

Figure 1:
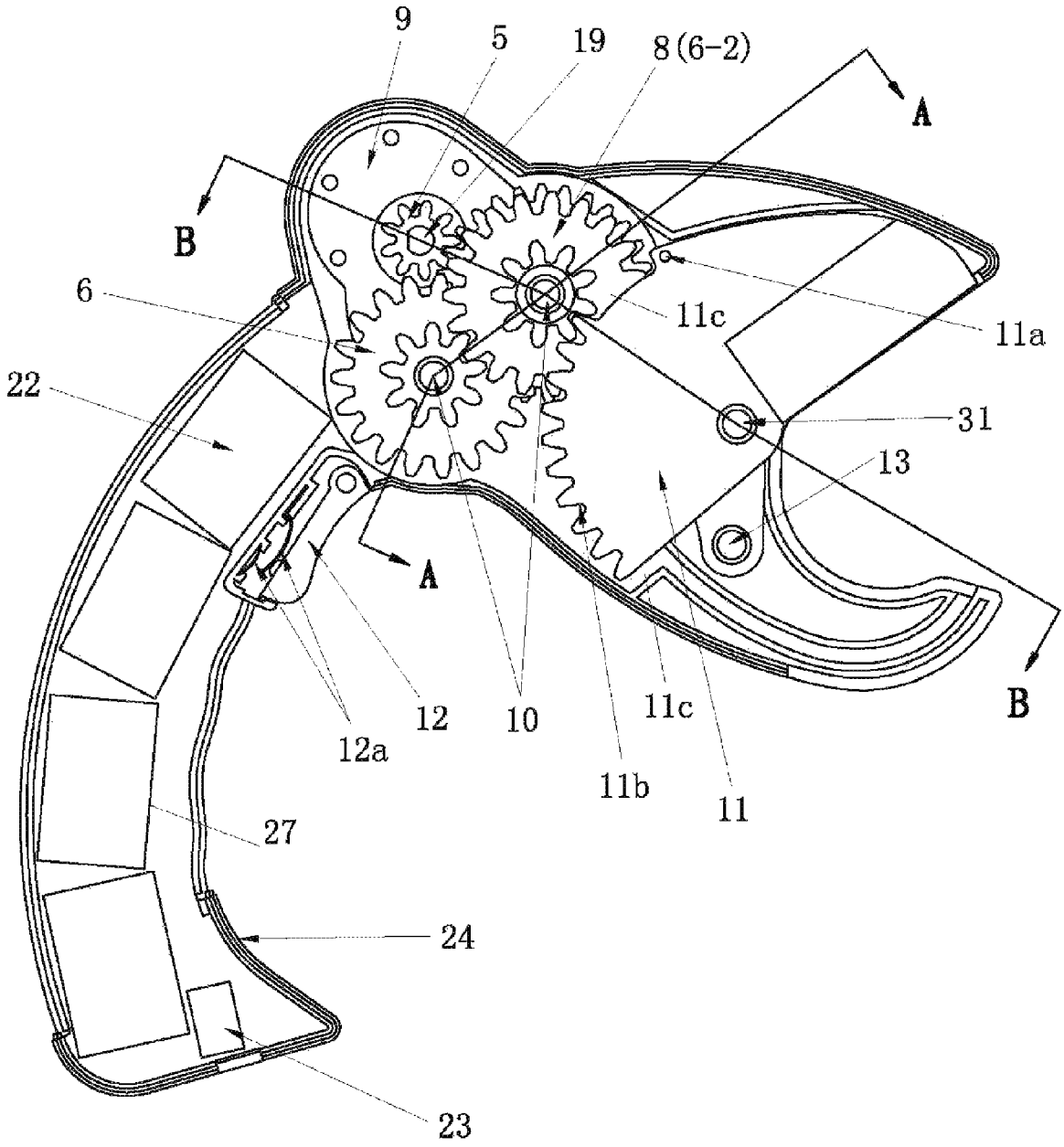
FIG. 1 is a structure diagram of a plastic pipe cutting tool according to the present invention.
Figure 2:
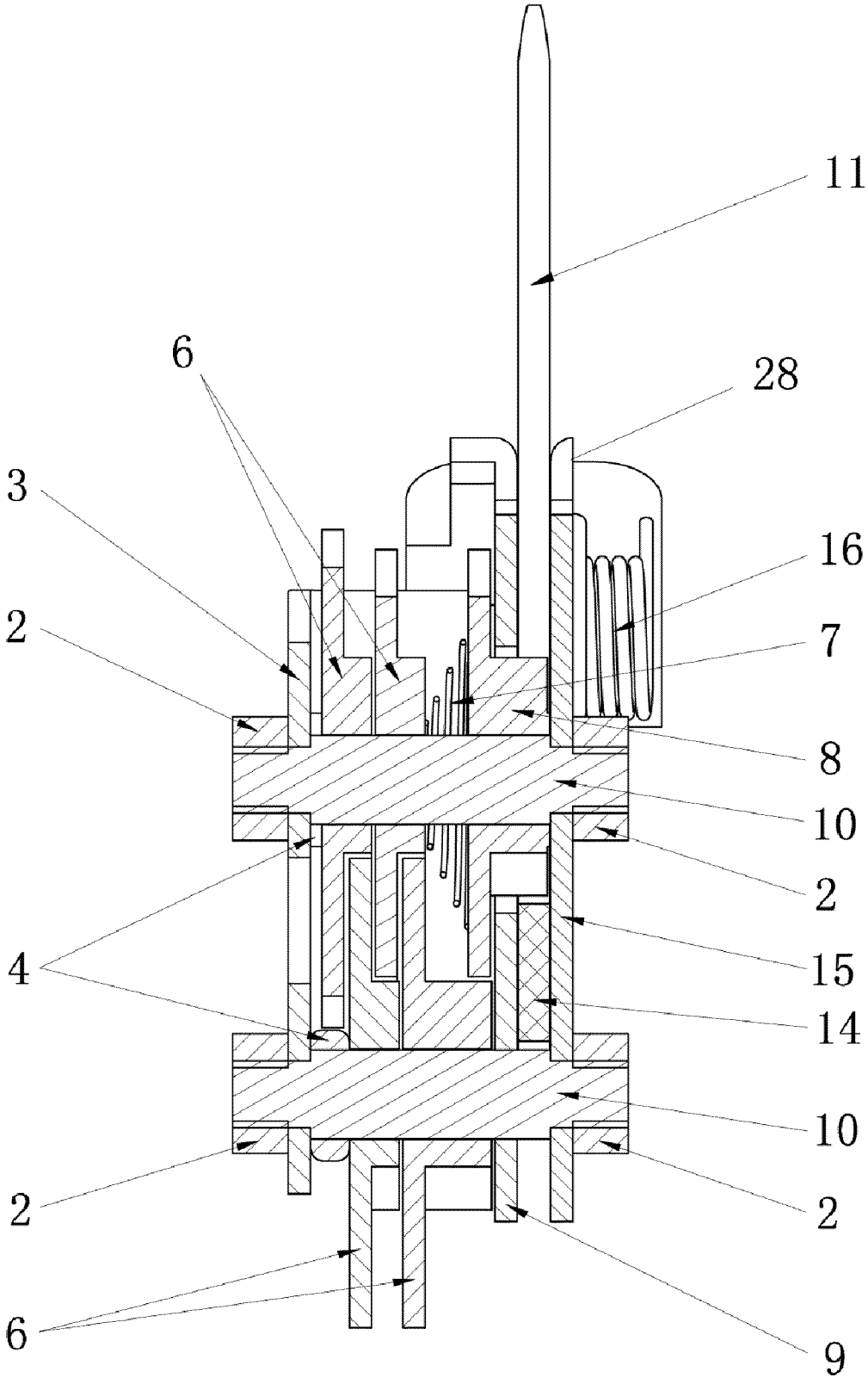
FIG. 2 is a sectional view taken along the line A-A (90 degree rotation) in the FIG. 1.
Figure 3:
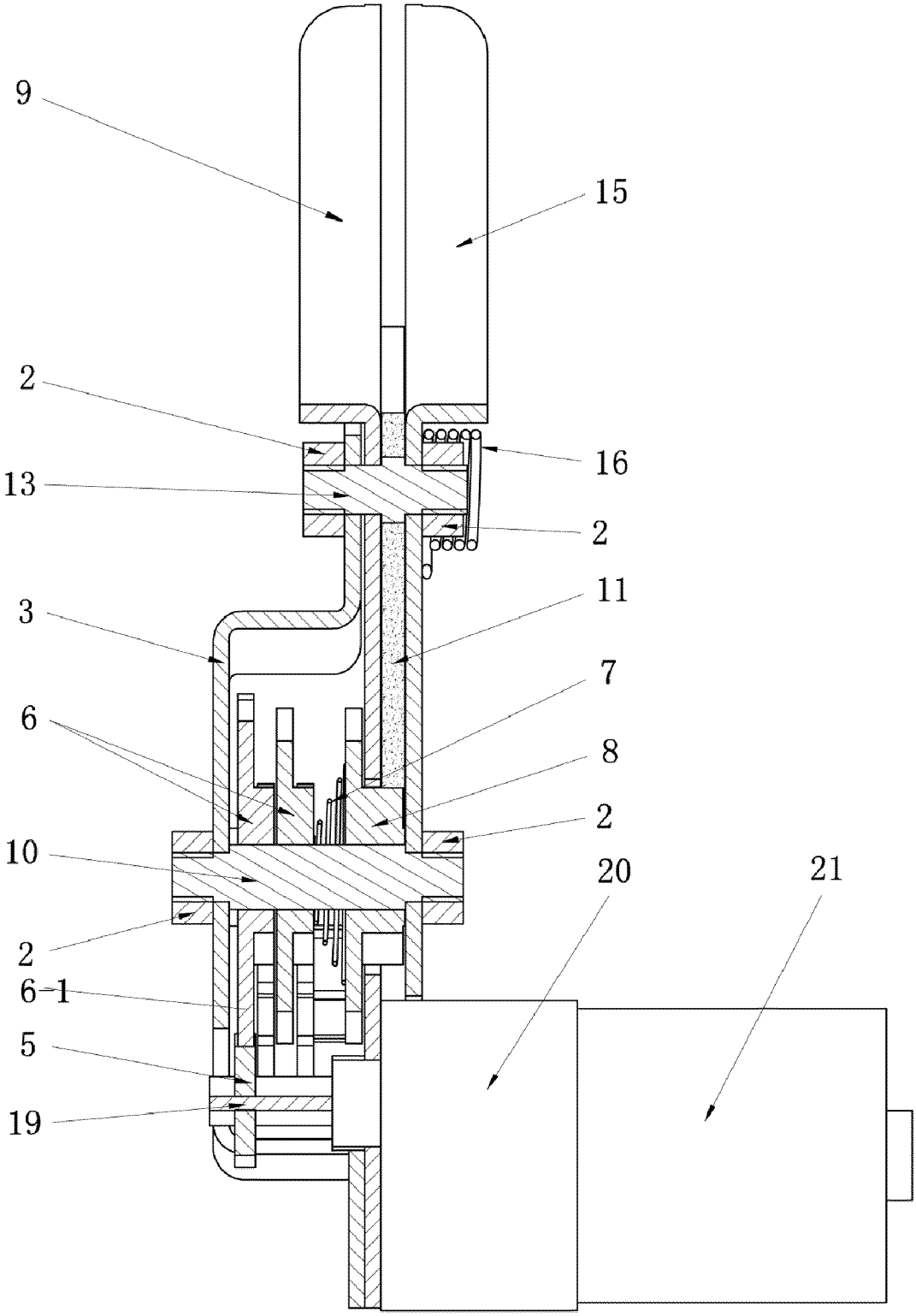
FIG. 3 is a sectional view taken along the line B-B (90 degree rotation) in the FIG. 1.
Figure 4:
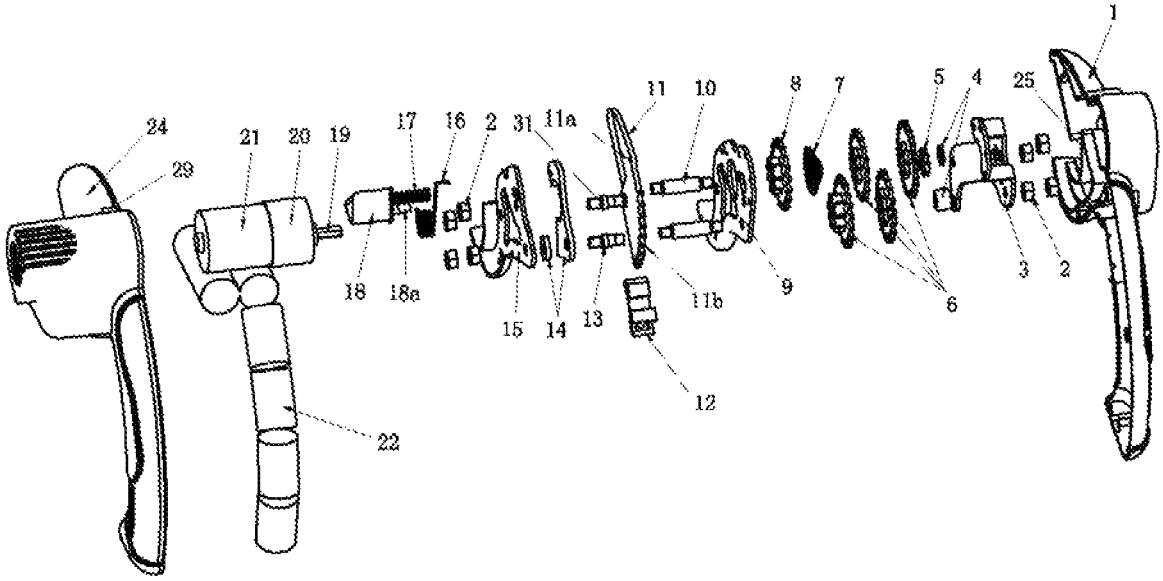
FIG. 4 is an exploded view showing the structure of a plastic pipe cutting tool.
Figure 5:
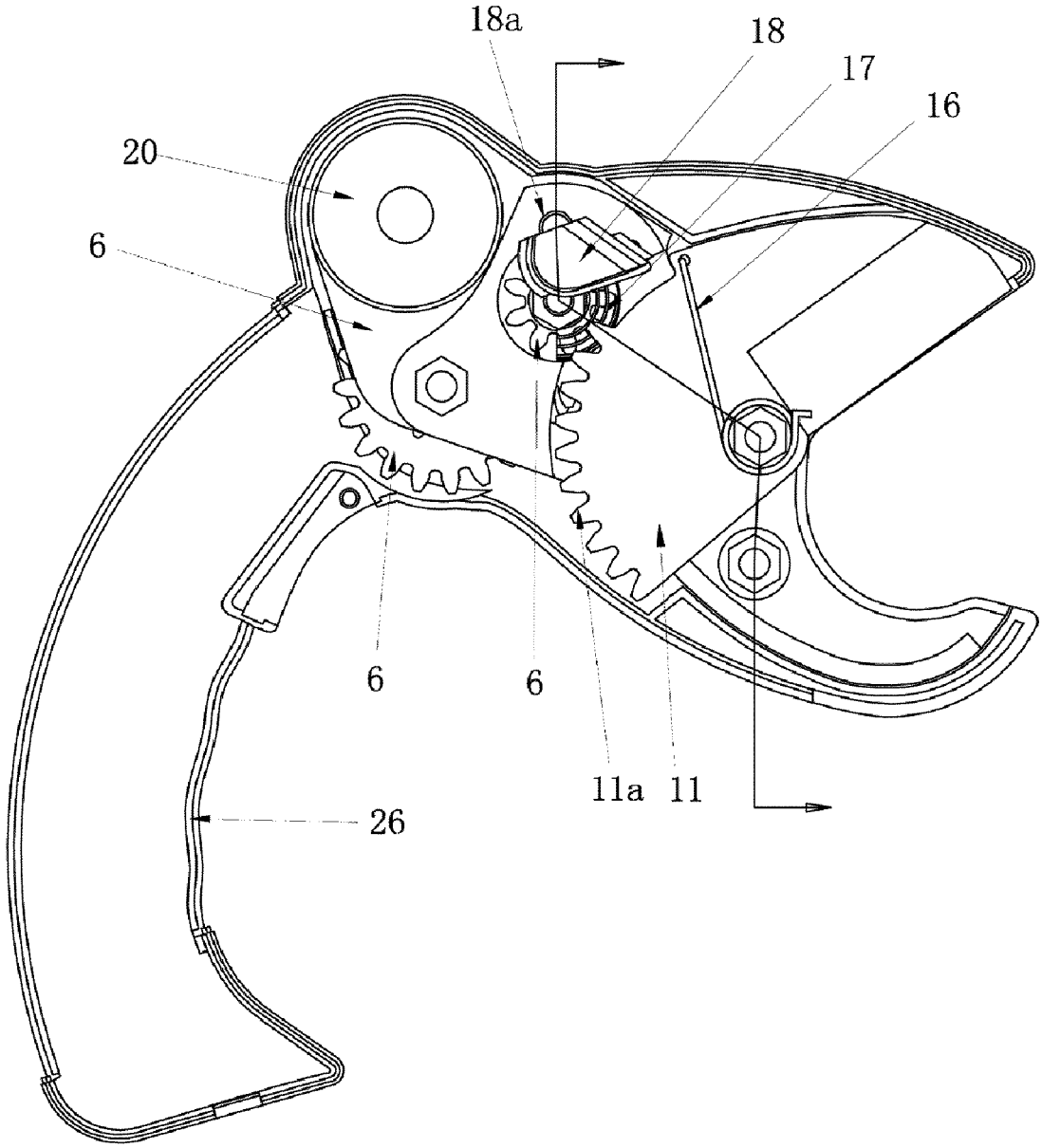
FIG. 5 is another structure diagram of a plastic pipe cutting tool.
Figure 6:
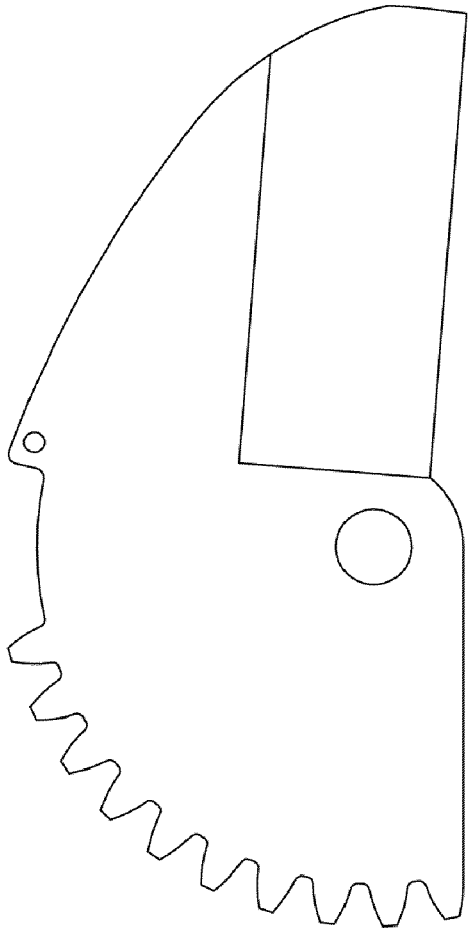
FIG. 6 is a schematic diagram of the blade.

1. left housing body: 2. fastening screw nut; 3. variable speed frame; 4. gasket; 5. transmission gear; 6, 6-1, 6-2. duplex gear; 7. clutch spring; 8. clutch gear; 9. left blade holder piece; 10. gear shaft; 11. blade 11*a*. blade hole; 11*b*. partial gear on tail portion of blade; 11*c* space; 12. switch; 12*a*. metal contact piece pairs in the switch; 13. restriction shaft; 14. restriction gasket; 15. right blade holder piece; 16. torsion spring; 17. repositioning spring; 18. repositioning button, 18*a*. repositioning button pillar; 19. output shaft; 20. gearbox; 21. motor; 22. power supply; 23. charging socket; 24. right housing body; 25. assembly chamber; 26. handle; 27. battery chamber; 28. blade holder; 29. button hole; 30. worm; 31. shaft; 32. transmission gear; 33. transmission rod; 34. rod journal; 35. eccentric wheel; 36. crankshaft; 37. braking element; 38. screw; 39. screw-nut pair

DETAILED DESCRIPTION OF THE PREFERRED EMBODIMENTS

Detailed description of the present invention will be made in the following by making reference to the preferred embodiments and accompanying figures.

EXAMPLE 1

As shown in FIGS. 1 to 6, a plastic pipe cutting tool comprises a housing body with a handle, the housing body is divided into left housing body 1 and right housing body 24, which are combined and fastened so as to form the housing body. The upper portion of the housing body is jaw-shaped, the middle-upper portion of housing body is an inflated assembly chamber 25 for assembling primary components including a motor 21, a variable speed gearing mechanism, a blade holder 28 and so on, and the middle-lower portion of the housing body is substantially an arc handle 26, in which a battery chamber 27 for containing plurality of battery as power supply 22 is disposed, the end of the handle 26 is provided with a charging socket 23 forming a charging circuit with connecting wire, the handle 26 is assembled in the front side with a switch 12, coordinating operation buttons and a metal contact piece pair 12*a* therein, with association of operation button 12, a loop circuit is composed of the motor, charging battery, and switch. The assembly chamber 25 is provided with a variable speed frame 3 fixed by screw nail, the variable speed frame 3 is provided with a plurality of parallel gear shafts 10 each of which is sleeved with ladderlike duplex gear 6 which are engaged with each other so as to form a gearing mechanism. In this example, five duplex gears 6 are provided.

The motor 21 is fixed on the blade holder 28, and a gearbox 20 is mounted to the output terminal of the motor 21, a transmission gear 5 is assembled on the output shaft 19 of the gearbox, the transmission gear 5 across through a via hole on the blade holder 28 and is engaged with a large gear of the first duplex gear 6-1 of the variable speed mechanism. The assembly chamber 25 is also provided with the blade holder 28 and a blade 11, the upper portion of the blade holder 28 is substantially jaw-shaped. The blade holder 28 is divided into two portions, i.e., left blade holder piece 9 and right knife-holder piece 15, and a restriction gasket 14 is lined there between to form an appropriate gap. The blade 11 is rotatable provided in the gap by shaft 31. The left blade holder piece 9 and right blade holder piece 15 are penetrated by a shaft pin and are combined and fastened with a screw nut so as to form a blade holder with the blade 11.

A cutting opening is formed in association with the blade 11 and the blade holder 28 for cutting plastic pipe. A restriction shaft 13 is disposed in the blade holder 28 to prevent the blade from over rotation. Alternatively a blade holder can be composed by combination of the shaft 31 and the restriction shaft 13. A partial gear 11*b* is disposed on the tail portion of blade 11, a space 11*c* is provided in the front and rear portion of the partial gear 11*b* for preventing transmission. The partial gear 11*b* on the tail portion of blade is engaged with a small gear of the last duplex gear 6-2 of variable speed gearing mechanism. To achieve the objective of fast knife-quitting and saving of energy, a clutch mechanism for repositioning the blade is disposed between the last duplex gear of said variable speed gearing mechanism and the partial gear on the tail portion of blade.

And the blade is disposed with a repositioning elastic element providing repositioning trends. The clutch mechanism has a simple clutch gear structure, said clutch gear 8 is the last duplex gear 6-2, which is sleeved on a parallel gear shaft 10 thereof, the gear shaft 10 is further sleeved with clutch spring 7 supporting two sidewalls of the duplex gears 6 on each side. A clutch elastic plate, a dual-spring or spiral spring can alternatively be used to support the clutch gear 8 and variable speed frame 3, playing the same role, as shown in FIGS. 8*a*, 8*b*, 9*a*, 9*b*, 10*a* and 10*b*. The housing body is provided on the surface with a button hole 29, in which repositioning button 18 is provided. A repositioning spring 17 is disposed between the repositioning button 18 and the blade holder 28, and a pillar 18*a* is extended from the inner side part of the repositioning button 18, crossing through a via hole on the blade holder and contacting with the sidewall of duplex gear acting as clutch gear 8. In the state where the repositioning button 18 is pressed on, said clutch gear 8 will overcome the elastic force generated from the clutch spring, disengage the partial gear 11*b* on the tail portion of blade. The repositioning elastic element can use torsion spring 16, which is sleeved on the shaft 31 of the blade 11 or on the screw nut. One end of the torsion spring 16 is connected to a blade hole 11*a* of the blade.

The working principle is as follows: the power supply 22 drives by the switch 12 the motor 21 to rotate, the rotation speed of the motor 21 is adjusted to a suitable speed by the gearbox 20, which is mounted to the motor 21, the speed is further changed after transmission by the gearbox 20 to a gearing mechanism composed of the duplex gear 6 in the variable speed frame 3, a clutch spring and clutch gear 8 is designed in the gear group of the variable speed frame 3, and the clutch gear 8 is kept in engagement with one gear of the gear group, and can move along a direction of left and right so as to engage by effect of the jacking force of spiral clutch spring 7, or disengage by pressing down the repositioning button 18 with the partial gear 11*b* on the tail portion of blade 11.

In the state that the blade is splayed and the clutch gear 8 is disengaged with the partial gear 11*b* of blade, if a pipe needs to be cut by using the cutting tool, one needs to place the pipes into a jaw-shaped groove between the blade 11 and the blade holder 28, then press down the switch 12 to make the motor 21 connected with the power supply 22, thereby the motor 21 start to rotate, the rotating motor 21 drives the gear in the gearbox 20 to rotate and to change speed. After speed is changed by the gearbox 20, to further lower the rotation speed and increase intensity, the output shaft 19 is connected by gear to the duplex gear 6 group in the variable speed frame 3 and drives the duplex gear group to rotate and change speed. The rotation of the gear in the variable speed frame 3 makes the clutch gear 8 rotate accordingly, and when the clutch gear 8 rotates to a position where it can engage with the partial gear 11*b* on the tail portion of blade, at this time, by the jacking force of the clutch spring 7 the clutch gear 8 is promptly engaged with the partial gear 11*b* on the tail portion of blade. After the engagement, the blade 11 will rotate along a direction to cut toward the pipe to be cut till it is cut off. After the pipe is cut off, because the space 11*c* is disposed on the end of the partial gear of blade to prevent from idling, the blade 11 will stop to rotate, and damage to the components of the cutting tool will be avoided.

In this state, to reposition the blade 11 one just need press down the repositioning button 18, as the repositioning button 18 is pressed, the clutch gear 8 is forced to separate from the partial gear 11*b* of blade, and when they are disengaged, the blade 11 will be back to the initial position by the torsion force of torsion spring 16.

EXAMPLE 2

Figure 7:
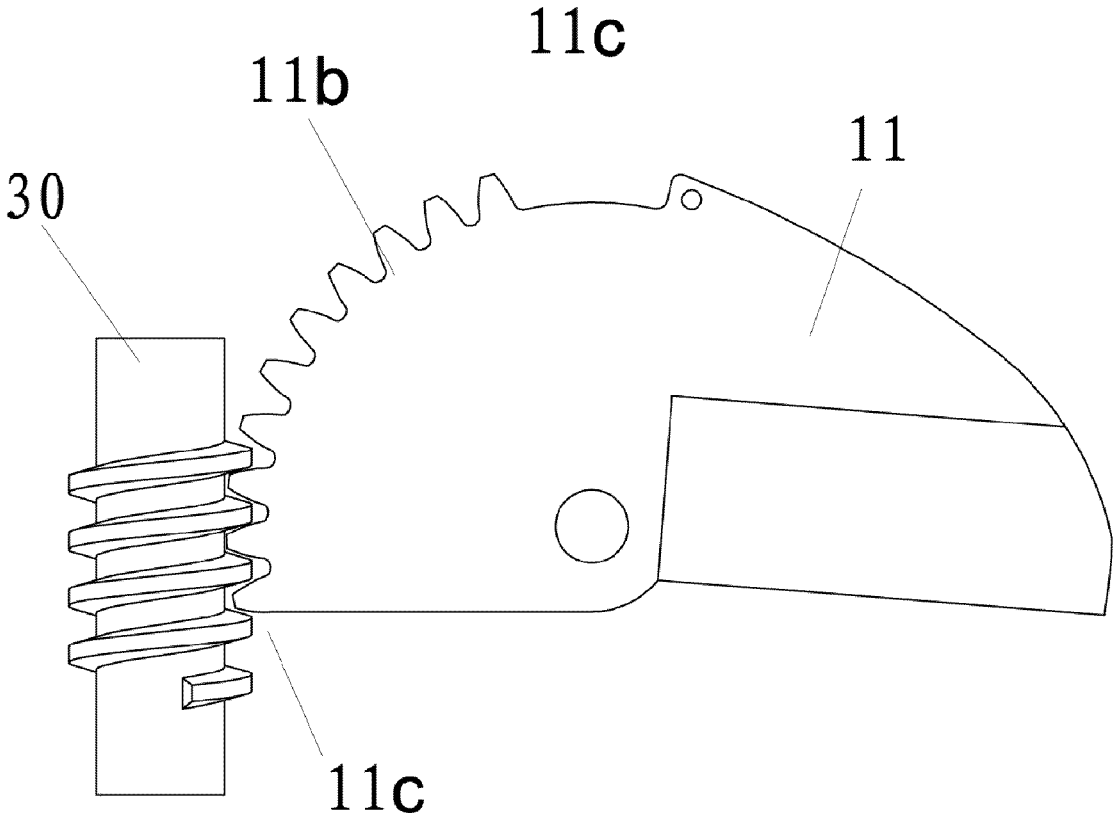
FIG. 7 is a working schematic diagram of another variable speed gearing mechanism.
Figure 8A:
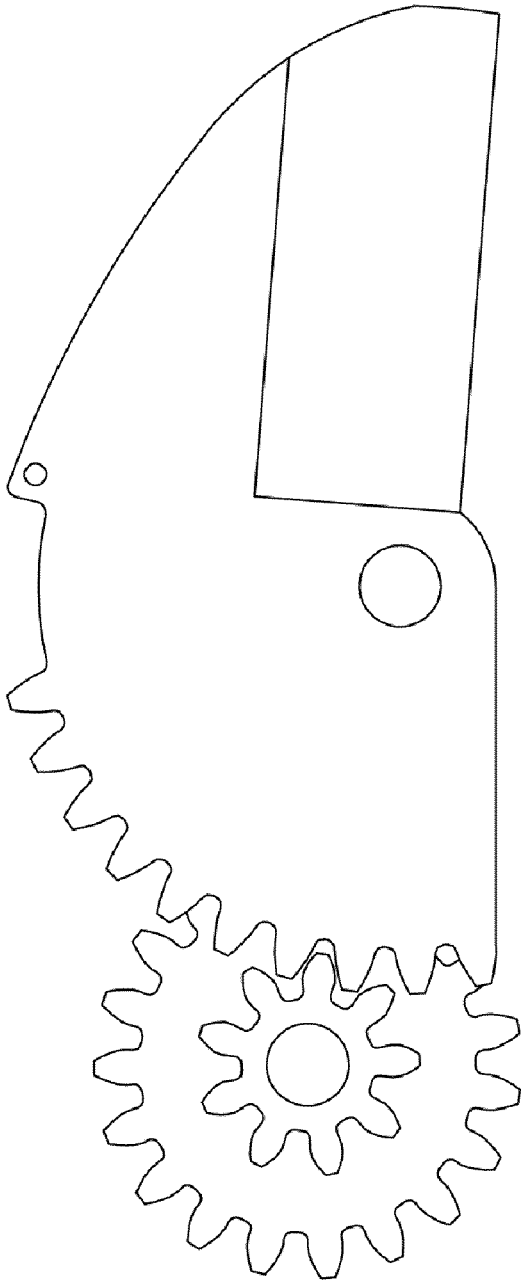
FIGS. 8*a* and 8*b* are schematic diagrams of another clutch mechanism.
Figure 8B:
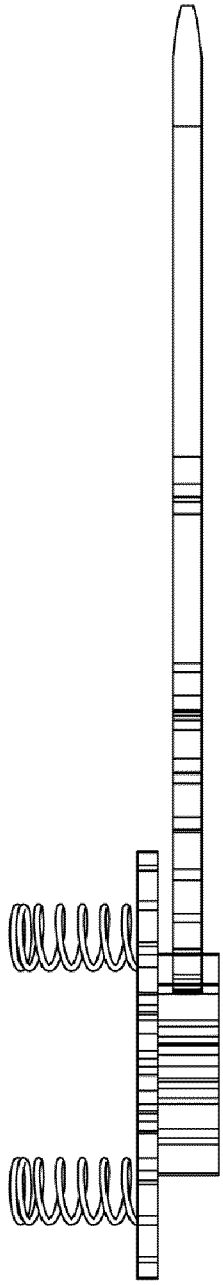
Figure 9A:
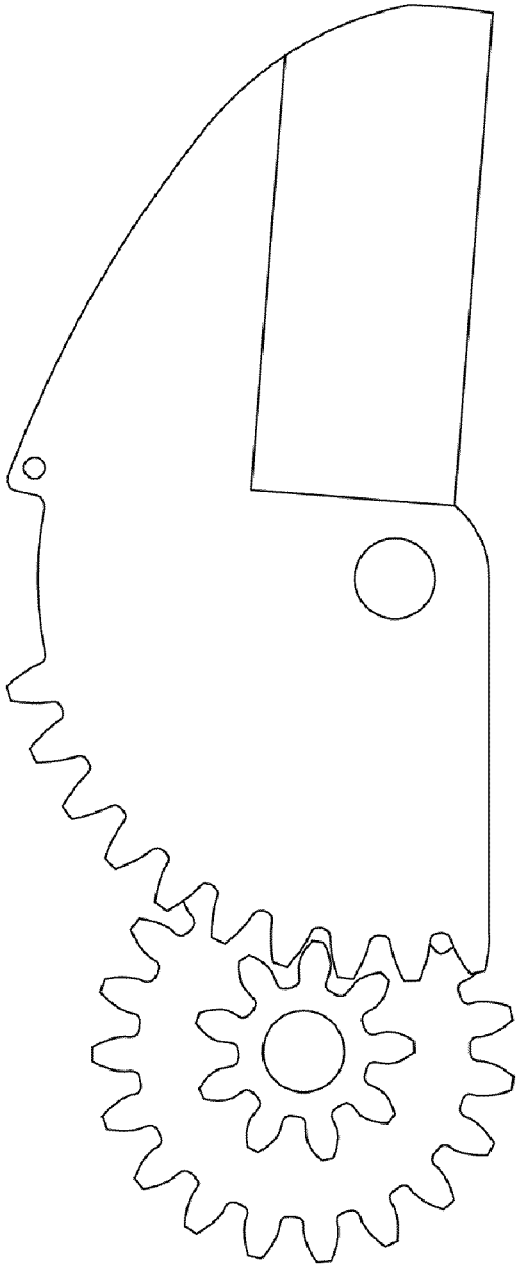
FIGS. 9*a* and 9*b* are schematic diagrams of the third clutch mechanism.
Figure 9B:
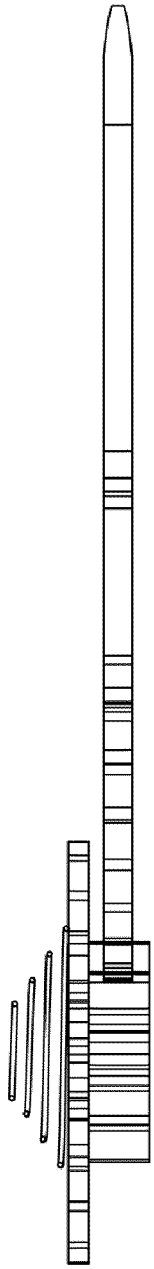
Figure 10A:
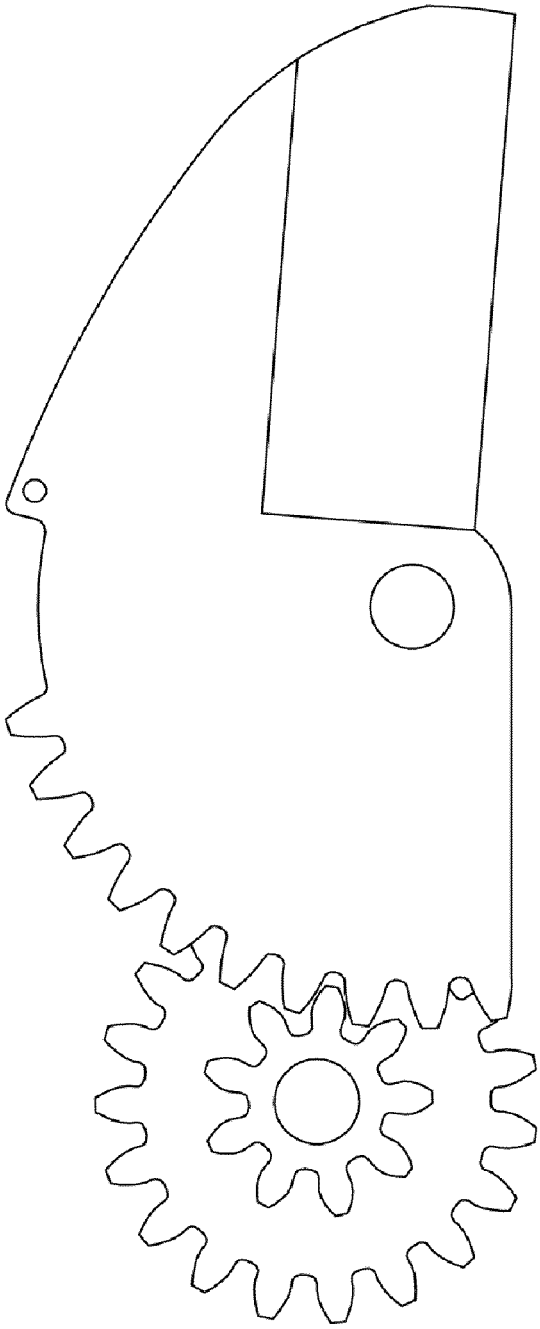
FIGS. 10*a* and 10*b* are schematic diagrams of the fourth clutch mechanism.
Figure 10B:
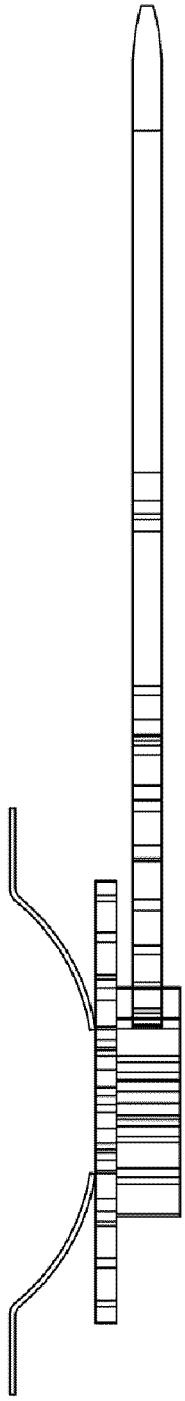

A plastic pipe cutting tool comprises a housing body with a handle, a blade holder mounted on the housing body and a rotatable blade associated with the blade holder to form a cutting opening, and said housing body is provided with a motor which is drivable connected with said blade via a variable speed gearing mechanism, and is further provided with a power supply which is electrically connected with the motor by switch to form a loop circuit, wherein said variable speed gearing mechanism further comprises a variable speed frame mounted to the housing body, the variable speed frame is assembled with rotary worm 30 that is connected by a coupling directly or indirectly with the output shaft of motor, the worm 30 is also engaged with partial gear 11*b* on the tail portion of blade 11 where provides with space 11*c* on the front and rear portions for preventing from transmission, as shown in FIG. 7. The others are same as the Example 1 except of a clutch mechanism.

EXAMPLE 3

Figure 11:
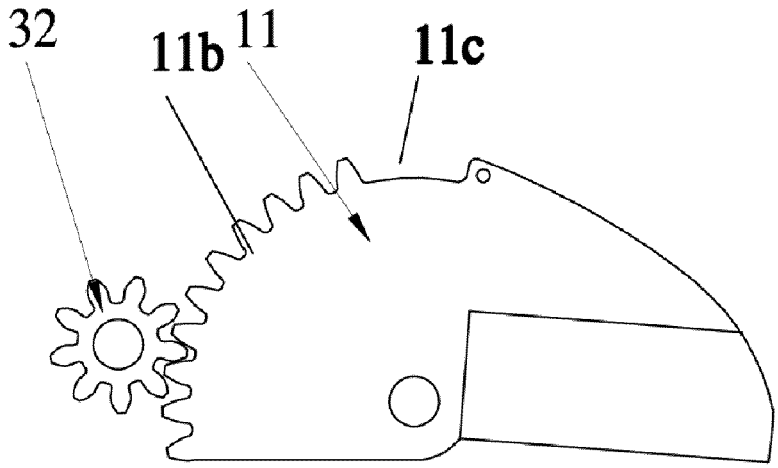
FIGS. 11 and 12 are structure diagrams showing that the gear drives the blade.
Figure 12:
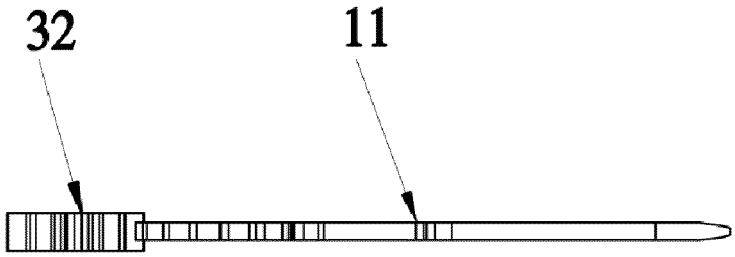

As shown in FIGS. 11-12, a plastic pipe cutting tool comprises a housing body with a handle, a blade holder mounted on the housing body and a rotatable blade associated with the blade holder to form a cutting opening, and said housing body is provided with a motor which is drivable connected with said blade via a variable speed gearing mechanism, and is further provided with a power supply which is electrically connected with the motor by switch to form a loop circuit, wherein a partial gear 11*b* is molded at the rear portion of blade 11, and a space 11*c* is disposed between the upper portion of the partial gear 11*b* and the upper edge of the blade 11, and a transmission gear 32 as a power section is further provided to engage with the partial gear 11*b* of the blade, and to connect directly or indirectly with the motor 21.

EXAMPLE 4

Figure 13:
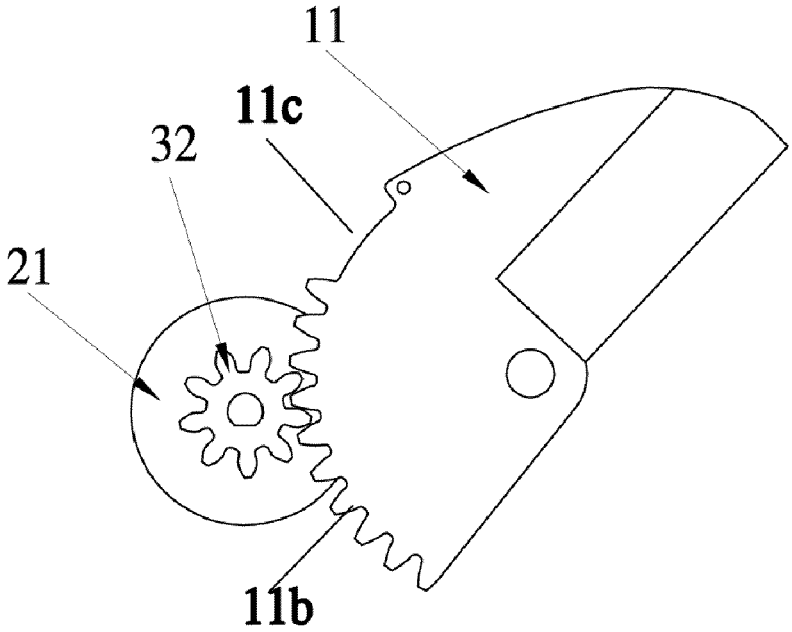
FIGS. 13 and 14 are structure diagrams showing that the motor directly drives the transmission gear that subsequently drives the blade.
Figure 14:
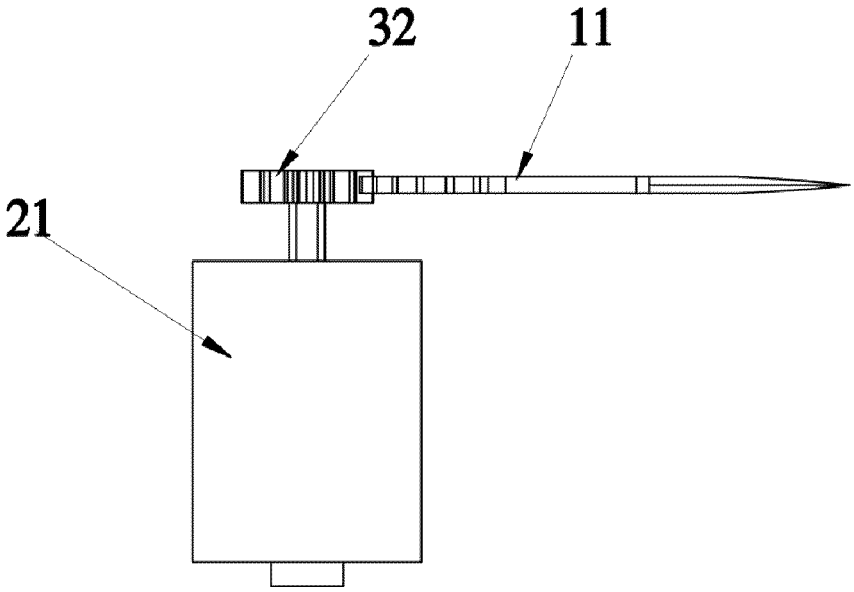

As shown in FIGS. 13-14, a plastic pipe cutting tool comprises a housing body with a handle, a blade holder mounted on the housing body and a rotatable blade associated with the blade holder to form a cutting opening, and said housing body is provided with a motor which is drivable connected with said blade via a variable speed gearing mechanism, and is further provided with a power supply which is electrically connected with the motor by switch to form a loop circuit, a partial gear 11*b* is molded at the rear portion of blade 11, and a space 11*c* is disposed between the upper portion of the partial gear 11*b* and the upper edge of the blade 11, and a transmission gear 32 is further provided to engage with the partial gear 11*b* of the blade.

In this example, the motor 21 is used as a force supplier directly applying forces to the blade 11 to make it rotate.

EXAMPLE 5

Figure 15:
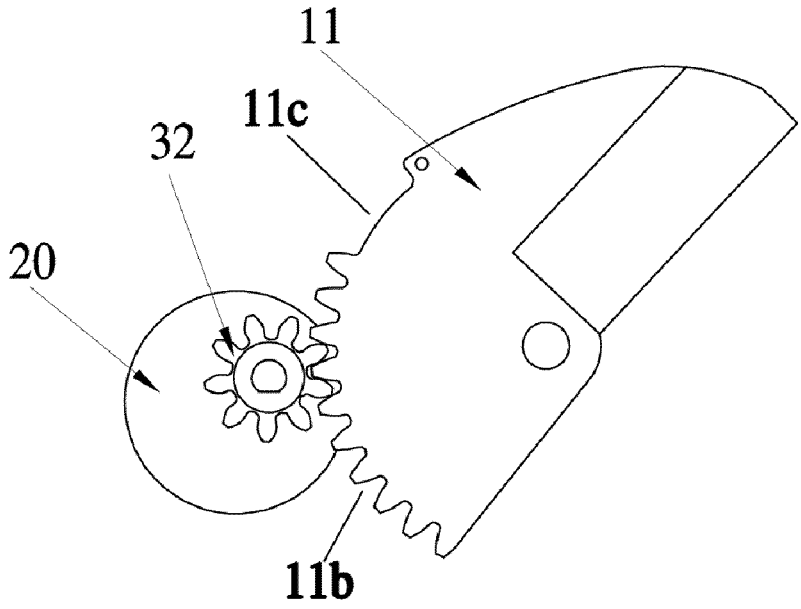
FIGS. 15 and 16 are structure diagrams showing that the motor drives by gearbox the transmission gear that subsequently drive the blade.
Figure 16:
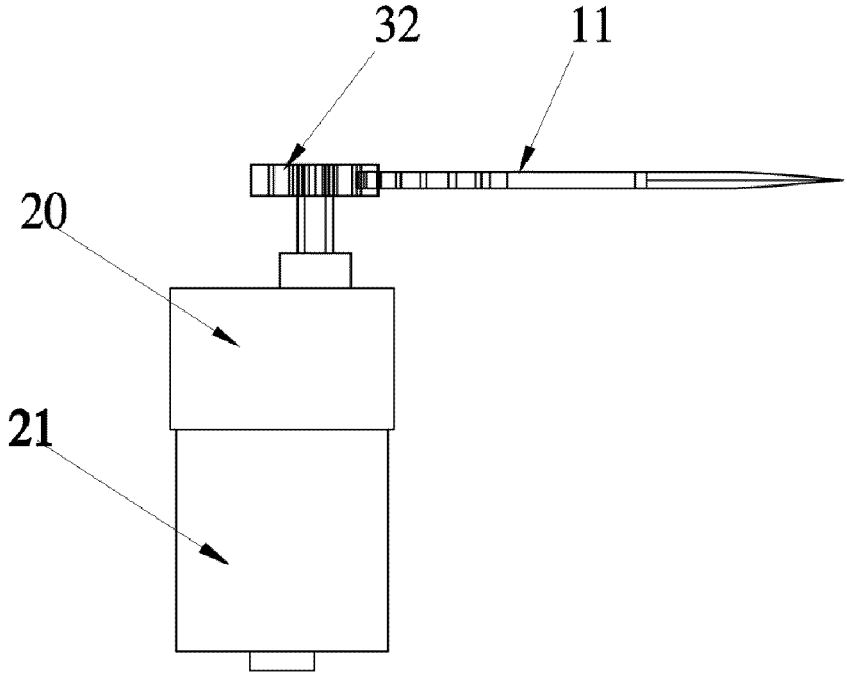

As shown in FIGS. 15-16, a plastic pipe cutting tool comprises a housing body with a handle, a blade holder mounted on the housing body and a rotatable blade associated with the blade holder to form a cutting opening, and said housing body is provided with a motor which is drivable connected with said blade via a variable speed gearing mechanism, and is further provided with a power supply which is electrically connected with the motor by switch to form a loop circuit, a partial gear 11*b* is molded at the rear portion of blade 11, and a space 11*c* is disposed between the upper portion of the partial gear 11*b* and the upper edge of the blade 11, and a gearbox 20, as power section, is fixed on the motor 21, a power shaft of the motor 21 is used as an input terminal of gearbox, and the output terminal of gearbox is used as an output shaft, the output shaft is provided with a transmission gear 32, which is engaged with the partial gear 11*b* of the blade.

In this example, the motor 21 is used as a force supplier applying forces to the blade 11 after speed change to make it rotate.

EXAMPLE 6

Figure 17:
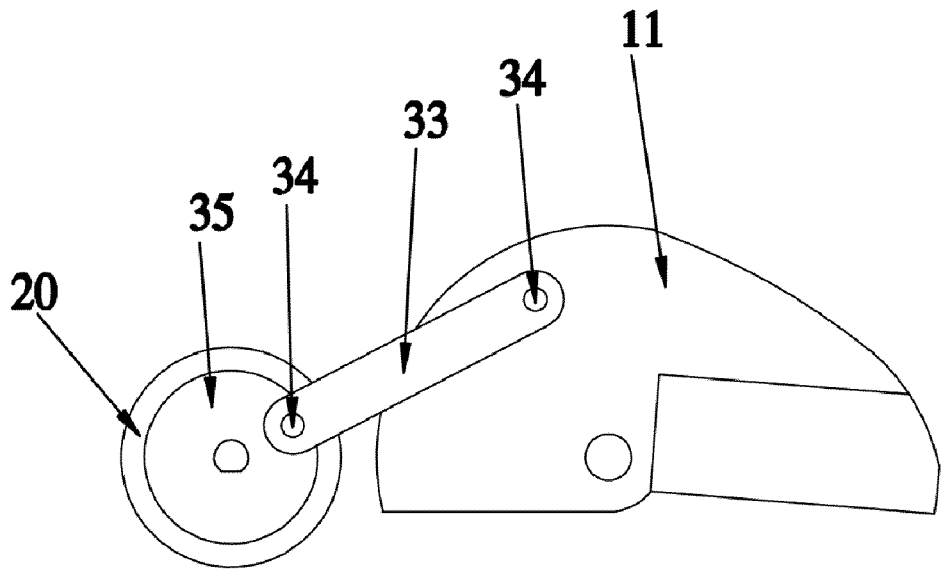
FIGS. 17 and 18 are structure diagrams showing that the motor drives the eccentric wheel that subsequently drive the blade through the transmission rod.
Figure 18:
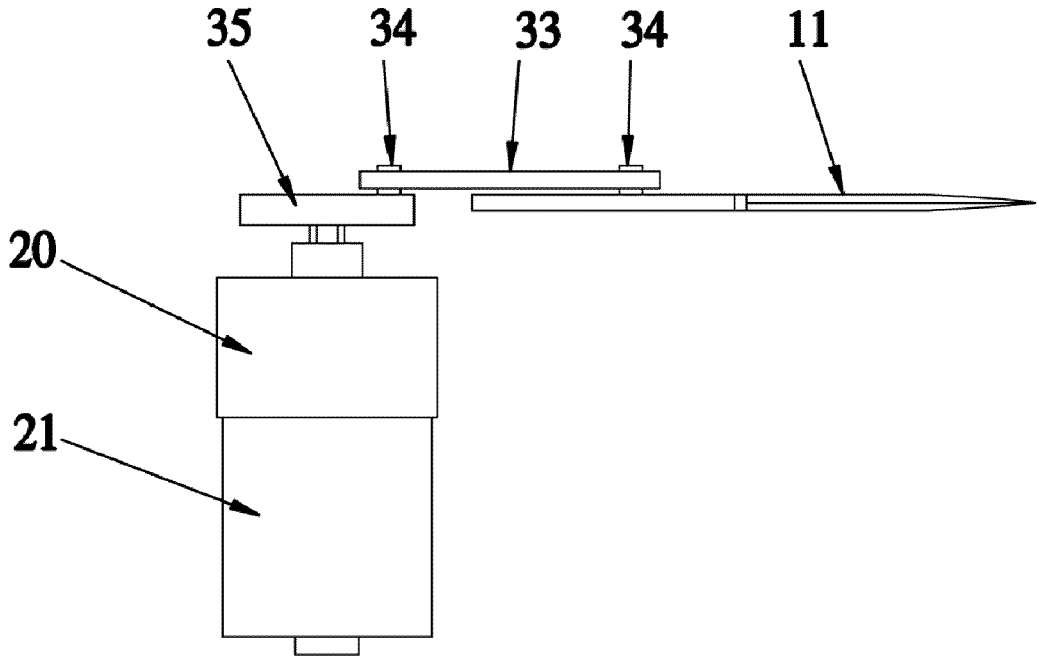

As shown in FIGS. 17-18, a plastic pipe cutting tool comprises a housing body with a handle, a blade holder mounted on the housing body and a rotatable blade associated with the blade holder to form a cutting opening, and said housing body is provided with a motor which is drivable connected with said blade via a variable speed gearing mechanism, and is further provided with a power supply which is electrically connected with the motor by switch to form a loop circuit, the middle-rear portion of blade 11 is moveably hinged with one end of a transmission rod 33, the other end of which is moveably hinged with side portion of an eccentric wheel 35 that is fixed on the output shaft using the motor as power section, the power section also comprise a gearbox 20 fixed on the motor 21, a power shaft of the motor 21 is used as an input terminal of gearbox, and the output terminal of gearbox is used as an output shaft.

In this example, the motor 21 is used as a force supplier making the eccentric wheel 35 to rotate. When the eccentric wheel 35 rotates, it makes the transmission rod 33 drive the blade 11 to rotate.

EXAMPLE 7

Figure 19:
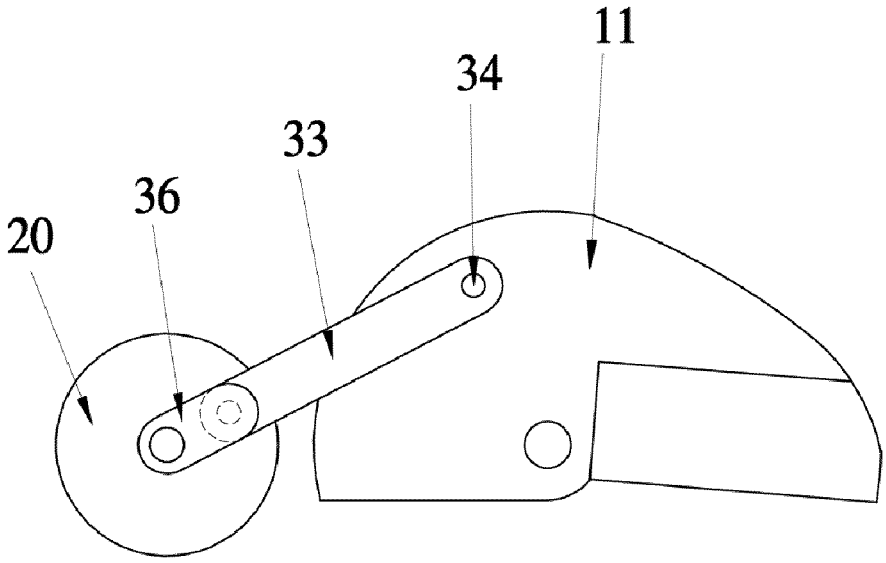
FIGS. 19 and 20 are structure diagrams showing that the motor drives the crankshaft that subsequently drive the blade through the transmission rod.
Figure 20:
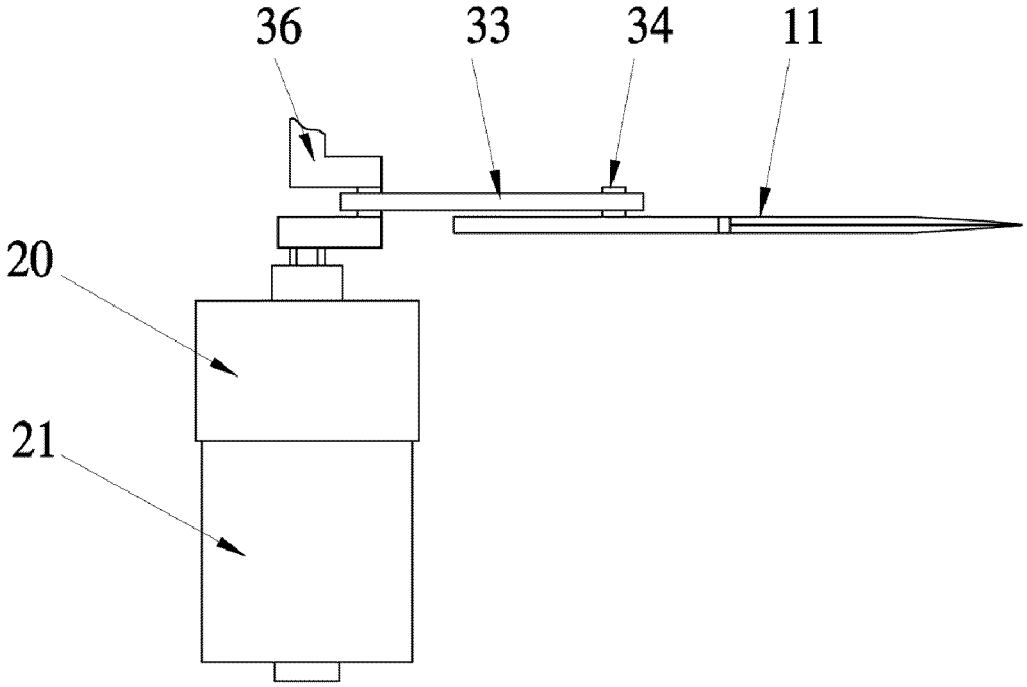

As shown in FIGS. 19-20, a plastic pipe cutting tool comprises a housing body with a handle, a blade holder mounted on the housing body and a rotatable blade associated with the blade holder to form a cutting opening, and said housing body is provided with a motor which is drivable connected with said blade via a variable speed gearing mechanism, and is further provided with a power supply which is electrically connected with the motor by switch to form a loop circuit, the middle-rear portion of blade 11 is moveably hinged with one end of a transmission rod 33, the other end of which is moveably hinged with side portion of a crankshaft 36 that is fixed on an output shaft using the motor as power section, the power section also comprise a gearbox 20 fixed on the motor 21, a power shaft of the motor 21 is used as an input terminal of gearbox, and the output terminal of gearbox is used as an output shaft.

In this example, when the motor 21 drives the crankshaft 36, and the crankshaft 36 drives the transmission rod 33 subsequently and the blade 11 rotate as the rotation of transmission rod 33.

EXAMPLE 8

Figure 21:
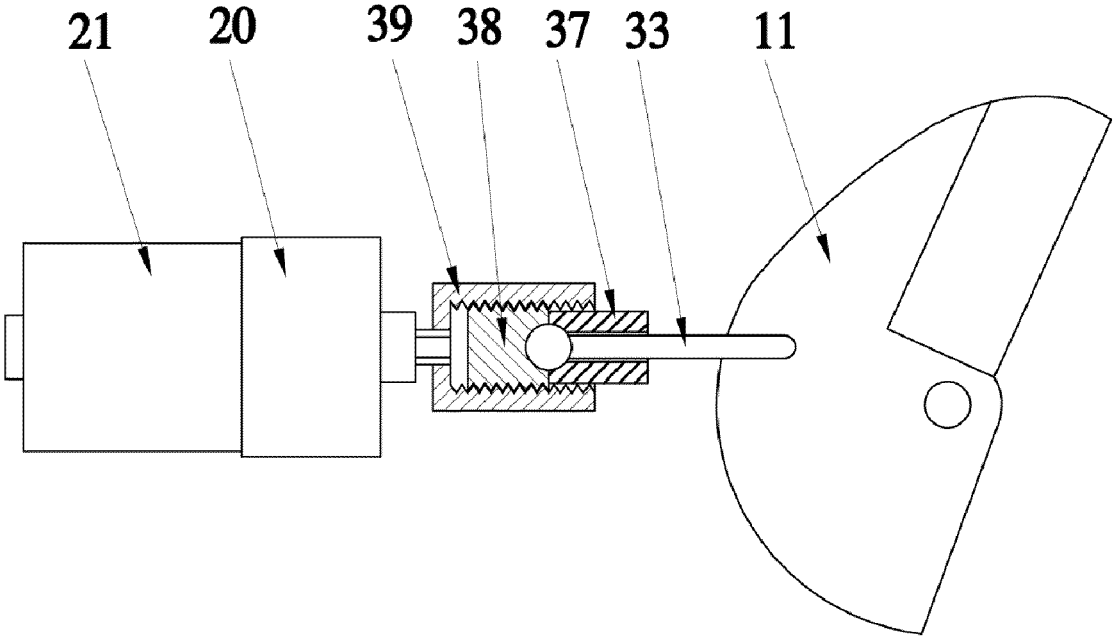
FIGS. 21 and 22 are structure diagrams showing that the motor drives the screw-nut pair that subsequently drive screw that drives the blade through the transmission rod.
Figure 22:
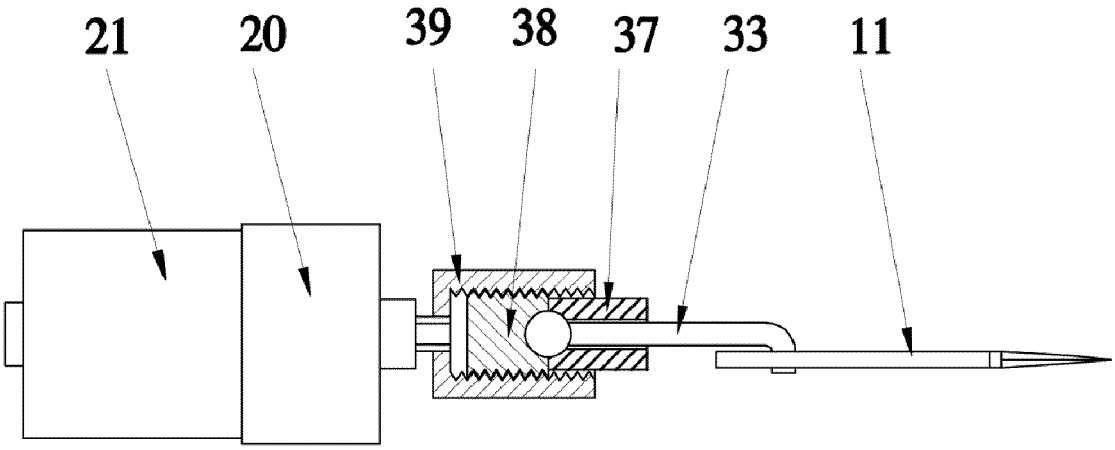

As shown in FIGS. 21-22, a plastic pipe cutting tool comprises a housing body with a handle, a blade holder mounted on the housing body and a rotatable blade associated with the blade holder to form a cutting opening, and said housing body is provided with a motor which is drivable connected with said blade via a variable speed gearing mechanism, and is further provided with a power supply which is electrically connected with the motor by switch to form a loop circuit, the middle-rear portion of blade 11 is moveably hinged with one end of a transmission rod 33, the power section also comprise a gearbox 20 fixed on the motor 21, a power shaft of the motor 21 is used as an input terminal of gearbox 20, and the output terminal of gearbox 20 is used as an output shaft, the output shaft has a fixed screw-nut pair 39 comprising a screw 38, the other end of the transmission rod 33 penetrate a braking element 37, and is coupled and contacted with one end of the screw 38.

In this example, the motor 21 is used as force supplier, and is provided with the screw-nut pair 39 comprising the screw 38 on which the transmission rod 33 and braking element 37 is disposed, thus when the screw-nut pair rotates, the screw 38 disposed in the screw-nut pair 39 is forced to rotate due to the braking element 37, as the screw 38 rotates, the transmission rod 33 is accompanied to rotate, and that drives the blade 11 to rotate.

What is claimed is:

1. A plastic pipe cutting tool comprising:

a housing body with a handle;

a blade holder mounted on the housing body and a rotatable blade associated with the blade holder to form a cutting opening; said housing body is provided with a motor;

a power supply which is electrically connected with the motor by a switch to form a loop circuit;

said motor is connected with said blade by a variable speed gearing mechanism;

said variable speed gearing mechanism comprises a variable speed frame mounted in the housing body, the variable speed frame is provided with a plurality of parallel gear shafts that are sleeved with duplex gears respectively, the duplex gears are engaged with each other so to form a multi-grade gearing mechanism, and a last duplex gear is engaged with a partial gear on a tail portion of the blade on which spaces are provided respectively on its front portion and rear portions preventing from transmission.

2. The plastic pipe cutting tool according to claim 1, wherein the blade holder is divided into a left portion and a right portion, and a restriction gasket is located between the left and right portions to form an appropriate gap, the blade is disposed by a shaft in the gap, the left portion and the right portion of the blade holder are penetrated by a shaft pin, and are combined and fastened with a screw nut.

3. The plastic pipe cutting tool according to claim 1, wherein said motor is fastened on the blade holder, a shaft of the motor is connected with an input shaft of a gearbox, and an output shaft of the gearbox has a gear to engage with a gear of the variable speed mechanism.

4. The plastic pipe cutting tool according to claim 1, wherein said power supply uses a rechargeable battery that is disposed in a battery chamber and is connected with a charging socket on an end of the handle, or uses a solar cell that is fixed on a surface of the housing body.

5. The plastic pipe cutting tool according to any one of claim 1 or 2 or 3 or 4, wherein a clutch mechanism for repositioning the blade is disposed between the last duplex gear of said variable speed gearing mechanism and the partial gear on the tail portion of the blade, accordingly the blade is disposed with a repositioning elastic element for repositioning trends.

6. The plastic pipe cutting tool according to claim 5, wherein said clutch mechanism is that a clutch spring or a clutch elastic plate disposed between the last duplex gear and the variable speed frame or the housing body to make the last duplex gear slide left and right, thereby the last duplex gear becomes a clutch gear; accordingly, a button hole is provided on a surface of the housing body, in which a repositioning button is provided; a button spring is disposed between the repositioning button and the variable speed frame or the housing body; besides, a side portion of the repositioning button is directly or indirectly contacted with a sidewall of the last duplex gear, thereby in a state that the repositioning button is pressed, said last duplex gear disengages from the partial gear of the tail portion of the blade.

7. The plastic pipe cutting tool according to claim 6, wherein said clutch spring or clutch elastic plate is on the parallel gear shaft of the clutch gear.

8. The plastic pipe cutting tool according to claim 5, wherein said repositioning elastic element is a torsion spring which is on a shaft of the blade, and one end of which is connected with the blade.

* * * * *